US006695075B2

(12) United States Patent
Beeker

(10) Patent No.: US 6,695,075 B2
(45) Date of Patent: Feb. 24, 2004

(54) SOIL SAMPLER

(75) Inventor: Arnoldus Emanuel Ruthgerus Beeker, Delft (NL)

(73) Assignee: Eijkelkamp Agrisearch Equipment B.V., Giesbeek (NL)

( * ) Notice: Subject to any disclaimer, the term of this patent is extended or adjusted under 35 U.S.C. 154(b) by 0 days.

(21) Appl. No.: 09/986,572

(22) Filed: Nov. 9, 2001

(65) Prior Publication Data

US 2003/0089526 A1 May 15, 2003

(51) Int. Cl.[7] ..... E21B 25/04
(52) U.S. Cl. ..... 175/58; 175/226; 175/249
(58) Field of Search ..... 175/20, 58, 226, 175/249; 73/864.1, 864.91

(56) References Cited

U.S. PATENT DOCUMENTS

| | | | | |
|---|---|---|---|---|
| 1,655,644 A | * | 1/1928 | Baker | |
| 2,820,610 A | * | 1/1958 | Martinez | |
| 2,862,691 A | * | 12/1958 | Cochran | |
| 2,880,969 A | * | 4/1959 | Williams | |
| 2,927,775 A | * | 3/1960 | Hildebrandt | |
| 3,008,529 A | | 11/1961 | Lynch et al. | |
| 4,479,557 A | * | 10/1984 | Park et al. | 175/59 |
| 4,598,777 A | * | 7/1986 | Park et al. | 175/58 |
| 5,673,762 A | * | 10/1997 | Pannington | 175/20 |

FOREIGN PATENT DOCUMENTS

| | | |
|---|---|---|
| DE | 1 131 616 | 6/1962 |
| DE | 43 28 273 C1 | 11/1994 |
| FR | 2.041.860 | 2/1971 |
| NL | 6902019 | 8/1970 |
| NL | 6914375 | 9/1970 |
| NL | 7906280 | 2/1981 |
| NL | 1009662 | 1/2000 |
| WO | 00/04238 | 1/2000 |

OTHER PUBLICATIONS

Heinz Muhs, "Entwicklung der Entnahmemethoden für Ungestörte Proben in Deutschland," *Baumaschine und Bautecknik*, V. 11, 1964, pp. 229–234.

* cited by examiner

*Primary Examiner*—William Neuder
(74) *Attorney, Agent, or Firm*—Young & Thompson

(57) ABSTRACT

The soil sampler includes a sampling tube having a receiving space for receiving a soil sample, the receiving space being limited in a radial direction by a wall, being open in a distal direction for permitting soil to enter and in a proximal direction being limited by a transverse wall, the transverse wall having ducts for supplying and discharge fluid to the receiving space and a plug for closing the ducts, a free plug or piston being placed in the receiving space closely fitting in there and movable between the transverse wall and the distal area of the sampling tube and the transverse wall and the free plug or piston defining a sealed chamber for fluid when the free plug or piston is situated at a distance from the transverse wall.

23 Claims, 4 Drawing Sheets

SOIL SAMPLER

TECHNICAL FIELD

The invention relates to a soil sampler, as well as to a method for taking soil samples.

BACKGROUND OF THE INVENTION

Soil samples are taken at a desired depth by means of a sampling tube, which is vibrated, screwed, driven, etc. into the ground by means of a drill string attached to the upper end thereof, until the desired depth is reached. The distal end (the lower end) of the sampling tube is provided with a valve, such as a cone, that is coupled to the sampling tube and closes a receiving space for the soil. An aid, such as a gripper, is lowered from above through the hollow drill string to receive the soil sample, with the coupling between the valve and the sampling tube disconnected. Subsequently, the drill string including the sampling tube is pressed deeper into the ground with room being made for the soil in the receiving space because the soil stops the valve with respect to the sampling tube.

Mechanical means such as balls, springs and pawls are used for coupling/uncoupling of the valve to/from the sampling tube. In actual practice, however, action of the mechanical means may quickly be impeded by soil particles.

An object of the invention is to overcome the above problem.

A further object of the invention is to provide a soil sampler that is simple in construction and is capable of working reliably over the long term.

Another further object of the invention is to provide a soil sampler that is well-suited for taking soil samples in a layer below a layer of granular material.

SUMMARY OF THE INVENTION

The present invention provides a soil sampler comprising a sampling tube having a receiving space for receiving a soil sample, the receiving space being limited in a radial direction by a wall, being open in a distal direction for permitting soil to enter and in a proximal direction being limited by a transverse wall, the transverse wall having line means for supplying and discharging fluid to the receiving space and with means for closing the line means, a free plug or piston being placed in the receiving space closely fitting in there and moveable between the transverse wall and the distal area of the sampling tube and the transverse wall and the plug or piston defining a sealed chamber for fluid when the plug or piston is situated at a distance from the transverse wall.

Thus, use is made of an incompressible fluid body for stopping the soil during movement of the end of the sampling tube to the wanted starting level. To permit entry of the soil, the fluid is permitted to escape via the line means. Mechanical provisions at the distal end of the sampling tube are not required. Long-term reliable action is guaranteed. The plug or piston has the same function as the known cone, but is freely slidable within the receiving space, without connection means to the sampling tube. When sampling occurs through one or several layers of material, particularly granular material, the receiving space can remain closed until the starting level for taking the soil sample has been reached.

Preferably, the plug or piston has a distal surface that is a part of the front surface of the soil sampler. The distal surface has a conical distal surface when the consistency of one or more of the soil layers necessitate a pointed-shaped end for penetration therein.

Preferably, the plug or piston is provided with a cavity in at least one of its axially oriented surfaces. The press force against the radial boundary of the receiving space and thus sealing against fluid leakage as well as against passage of soil material past the plug or piston are improved.

Optimization of the sealing against fluid leakage is obtained when the plug or piston at the proximal side is in liquid-sealing engagement with the wall surface of the receiving space according to a line shaped contact.

A comparable measure can be taken at the distal side of the plug or piston for counteracting soil leakage.

Preferably, the plug or piston has a diabolo-like or hourglass shape.

Preferably, the line means comprise a fluid duct extending through the transverse wall. A valve that can be remotely controlled is present for selectively opening the fluid duct. Preferably, the valve is a one-way valve that is biassed against the distal end of the fluid duct. It is furthermore preferred that the valve comprises a valve disc and a valve rod connected thereto, the valve rod extending through the fluid duct to the proximal side of the transverse wall and being biassed at that location by means of a compression spring. Preferably, the fluid duct is adapted for selective discharge of fluid from the receiving space. When the receiving space is filled with fluid, the valve will prevent escape. When it is desired to let the fluid escape, the valve is operated by pressing against the valve rod by means of a lowered weight, so that the fluid can flow out of the receiving space, corresponding to the volume of the received soil.

Discharge of the fluid can occur via the same duct. It is preferred, however, that the line means comprise a separate and closable supply duct for the fluid.

The supply duct also supplies fluid to the receiving space after raising the soil sampler in order to press out the soil sample.

Preferably, the sampling tube is provided with a core catcher at the distal end to prevent a soil sample of noncohesive material from spilling out after the soil sample has been received.

It may be desirable to pack the soil sample. To that end, according to the invention, means are provided for at least radially enveloping the soil sample received in the receiving space.

In one embodiment, the enveloping means comprise a sleeve arranged at the distal end of the sampling tube such that it can be unwound and extending with a closed end over the open distal end of the receiving space. The sleeve can then be pulled along and unwound by the entering soil.

In case there is a plug or piston, it may be advantageous in the preparation of the soil sampler that the plug or piston is connected to the sleeve.

In an alternative embodiment, a liner is placed in the sampling tube, which liner covers the inner surface of the sampling tube at the location of the receiving space. The liner is already at the desired place prior to the soil sample being taken. It is preferred that a fluid seal is placed between the liner and the sampling tube in order to close off a possible leakage path for the fluid in the receiving space.

Preferably, the plug or piston is in engagement with the inner surface of the liner.

The present invention also provides a method for taking soil samples, wherein a sampling tube having an open end giving access to a receiving space for the soil sample is filled with fluid, is forced into the ground until the location is reached where the soil sample is to be taken, the fluid is given the opportunity to escape while pushing the sampling tube deeper into the ground so that the wanted soil enters the receiving space.

The invention thus provides a method wherein the fluid filled receiving space is sealed to the outside with a fluid sealing free piston, wherein the soil moves the piston to the inside while urging the fluid out when the soil enters.

After disconnecting the cone in known soil samples, soil samples can only be taken from the same location. One or several of the preferred constructions according to the invention discussed above, however, permit closing of the receiving space again at any wanted moment, so that any remaining fluid and the soil already received forms a sealing at the distal end of the sampling tube.

To that end, the invention provides that the receiving space is only partially filled with soil, the fluid is stopped again from escaping, the sampling tube is urged further into the ground to a lower spaced apart desired location, the fluid is given another opportunity to escape while pushing the sampling tube deeper into the ground so that the wanted soil enters the receiving space.

After the soil sampler has been raised, the receiving space is preferably filled with a pressurized fluid to urge the soil sample out of the sampling tube.

BRIEF DESCRIPTION OF THE DRAWINGS

The invention will be further described in greater detail on the basis of a number of exemplary embodiments shown in the attached drawings, in which.

DETAILED DESCRIPTION OF THE DRAWINGS

Figure 1A:
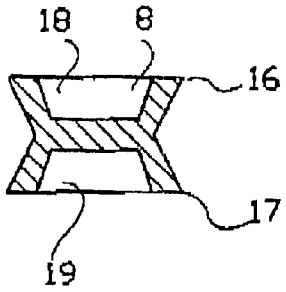
FIG. 1A is a cross-sectional view of a free piston used in the embodiment of the sampler according to FIG. 1.
Figure 1:
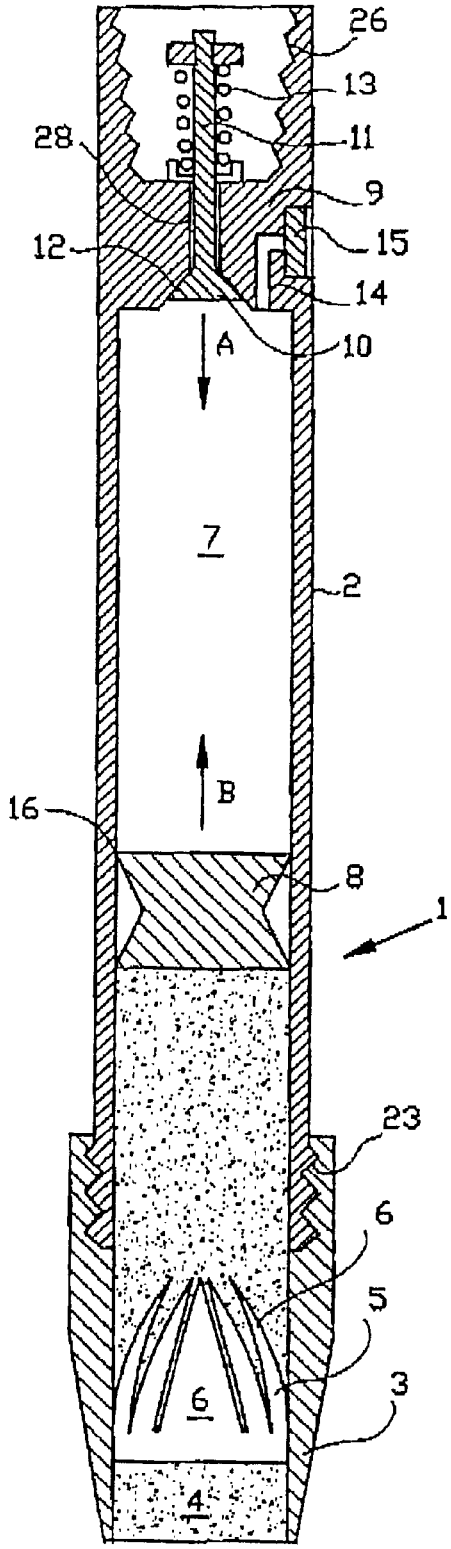
FIG. 1 is a longitudinal sectional view of a lower end of a first embodiment of a sampler according to the invention.

In FIG. 1 is shown a sampler 1 having a stainless steel sampling tube 2 of a length of about 1.5 meters and a cutting shoe 3 made of hardened metal with a sharp cutting angle. The shoe is screwed on the lower end of the sampling tube via a threaded connection 23. The cutting shoe 3 defines a passage 4 to the inside of the sampling tube 2.

A core catcher 5 is attached to the inner surface of the cutting shoe 3. The core catcher 5 is provided with lips 6 that can be bent away radially to the outside to allow soil to pass in an upward direction but prevent movement of the soil in a downward direction. Core catchers are generally known and are specifically used when a sand sample is to be taken.

The sampling tube 2 forms a chamber 7 that is bounded at the upper end by a wall 9. A valve 10 is present in a passage 28 in the wall 9 and abuts a seat 12 for sealing. The valve 10 is provided with a valve rod 11 that is biassed in an upward direction by means of a spring 13 so that the valve 10 seals off the passage 28 around the valve rod 11. The wall 9 is furthermore provided with a duct 14 extending from the chamber 7 to the outside and is closed off by a removable plug 15.

The sampling tube 2 is provided with a screw thread 26 above the wall 9 for connection to a drill string (not shown).

The chamber 7 provides room for a free piston 8 which can be made of hard rubber. As shown in FIG. 1A, the piston 8 has a more or less diabolo-like or hourglass shape having an uppermost circumferential edge 16 and a lowermost circumferential edge 17 and cavities 18 and 19 on the top side and the bottom side.

The sampler 1 of FIG. 1 can be used as follows: The plug 15 is removed and a source of an incompressible fluid, such as water, is connected to the duct 14. The fluid flows into the chamber 7 under pressure, and will move the piston 8 to the distal end portion of the sampling tube 2. When the piston 8 has been moved far enough towards the distal end, the duct 14 is closed by the plug 15. The chamber 7 is upwardly closed by the valve 10 and downwardly closed by the piston 8. The shape of the cavity 18 and the circumferential edge 16 prevent downward leakage of the fluid past the circumference of the piston 8. The piston is kept in its place by friction with the sampling tube wall and by the influence of the closed-off fluid filled chamber 7.

Subsequently, the soil sampler 1 including the sampling tube 2 and the cutting shoe 3 are inserted into the ground and pushed by means of the drill string to almost above the layer of which the soil sample is to be taken. A weight or another operating means, such as a rod, is then lowered through the hollow drill string to press the end of the valve rod 11 downwards. A stone having a weight of 1 kg on a wire may be used when the soil sampler is screwed into the ground and the spring pressure of the valve need not be high. A rod is recommended when vibrations occur and the spring pressure is about 10 kg. As a result of the downward movement of the valve rod 11, the valve 10 opens in the direction A. With further downward movement of the sampler 1, the piston 8 will move upward in the direction B because the fluid is able to flow out of the chamber 7, through the passage 28 for the valve rod 11, to the hollow space above the wall 9. Thus, room is made within the sampler 1 for soil entering via the passage 4.

When the piston 8 is urged upward under the influence of the soil pressure, the circumferential edge 17 together with a line-shaped contact and the cavity 19 ensure that no soil material can move upwards past the piston 8.

When the piston 8 is moved upwards inside the sampling tube 2 to a desirable amount, the valve rod 11 is unloaded, and the chamber 7 is closed again. The sampler can then be raised with the piston and the column of soil secured against downward movement. A vacuum may arise in the chamber 7 which offers an upward force against downward movement of the soil sample.

In the case of a non-cohesive material such as coarse sand, further security against downward movement is provided by the core catcher 5.

After the soil sampler 1 has been brought above ground level, the plug 15 can be removed and the fluid supplied again in order to urge the piston 8 and thus the soil sample in the chamber 7 to the distal end and out of the sampler.

Consecutive samples can be taken from soil layers that are situated at different depths. In that case, when the piston has come halfway of the original chamber 7, the weight will be removed earlier from the valve rod 11 and then the sampler 1 pressed further downward into the ground, the lower end of the soil sample taken then forming the end plane of the sampler 1. Possibly, the soil will be compressed to some extent, though this can be taken into account in the analysis of the soil sample.

When, after having penetrated further into the soil two meters, the weight can be brought onto the valve rod 11 again to open the valve 10 and subsequently by pressing in the sampler 1 further in the soil, taking the next sample. Finally, in the manner discussed above, the sampler 1 can be raised again after taking all the wanted soil samples.

Figure 2:
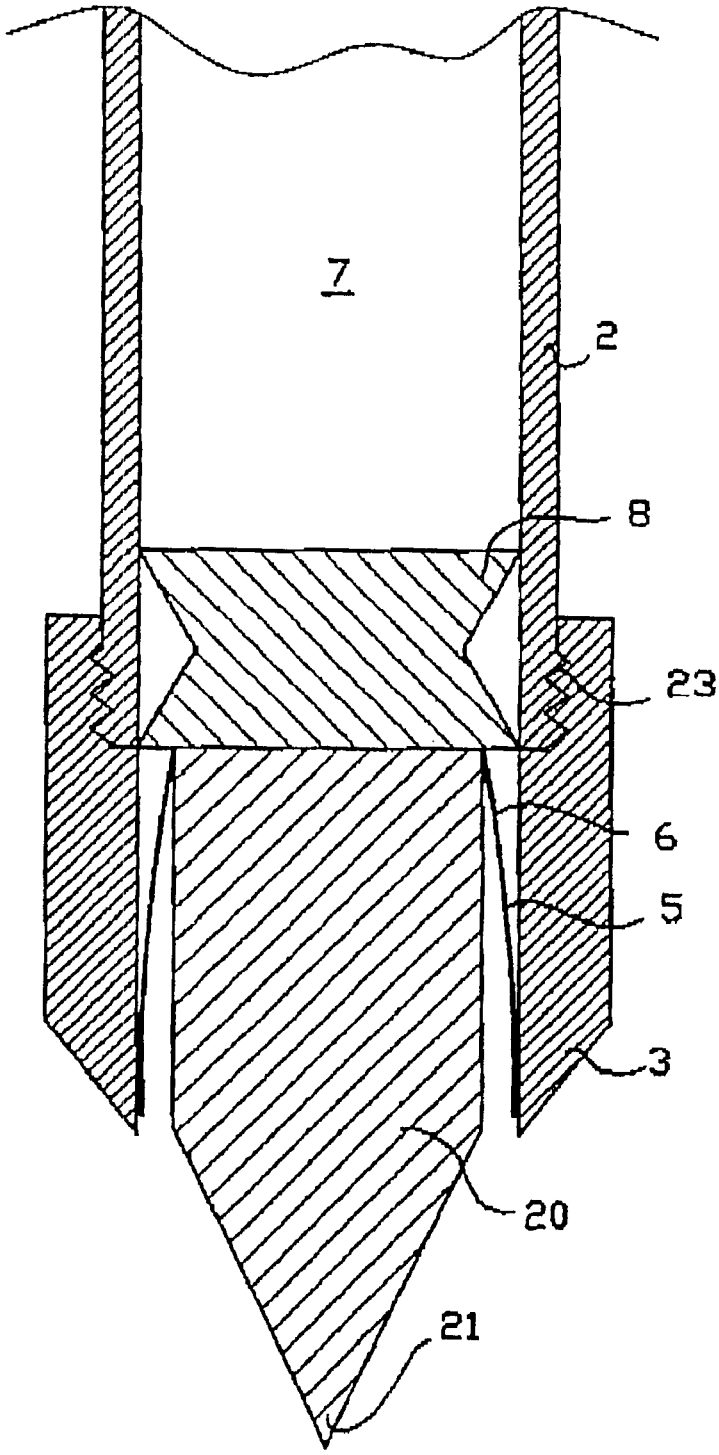
FIG. 2 is a longitudinal sectional view of a lower end of a second embodiment of the sampler according to the invention.

In FIG. 2, the sampler 1 is given a pointed shape for penetration into the soil. A hard rubber cone 20 with a tip 21 is placed at the lower surface of the piston 8. The cone can form a separate part with respect to the piston 8 or glued to the piston. The cone is only deployed when the soil in question necessitates such. Further, the operation of the embodiment of FIG. 2 is the same as that of FIG. 1. When taking samples using the embodiment of FIG. 2, the volume of the cone 20 should be taken into account.

Figure 3:
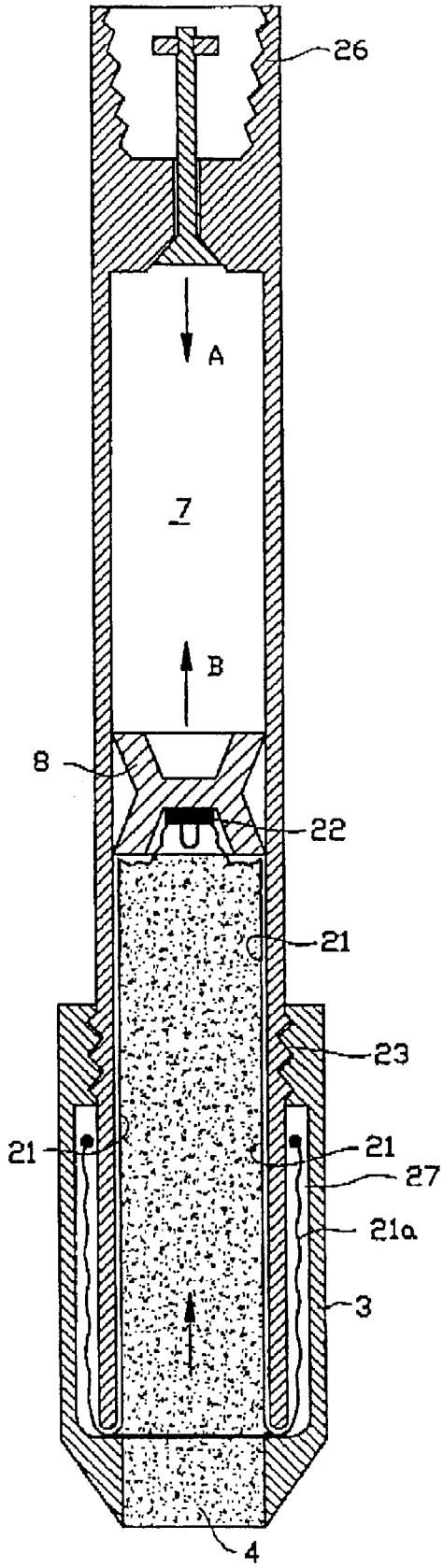
FIG. 3 is a longitudinal sectional view of a portion of a third embodiment of the sampler according to the invention.

In FIG. 3, the soil sample is packed immediately in a so-called sleeve. The shoe 3 is extended in the proximal direction and forms an annular chamber 27 with the extended sampling tube 2. An end of a rolled up permeable nylon sleeve 21 there is attached in that chamber, the annular chamber 27 thus offering room to a stock 21*a* of the sleeve 21. The sleeve 21 extends downwards and extends about the lower end of the sampling tube 2 to the inside and upwards, in order to be closed with the other end. The end of the sleeve may be attached to the piston 8 at the location 22.

When the valve 10 is opened and the sampler 1 is urged downwards into the ground, the soil entering the space below the piston 8 will move the piston 8 upwards and also move the end of the sleeve 21 upwards, the sleeve being able to unwind from the stock 21*a* accommodated in the annular chamber 27, until the wanted sample length is achieved. After raising the sampler and after screwing the cutting shoe 3 off, the portion of the sleeve that is situated at the outside of the sampling tube 2 can be engaged to make a sleeve sealing there.

Figure 4:
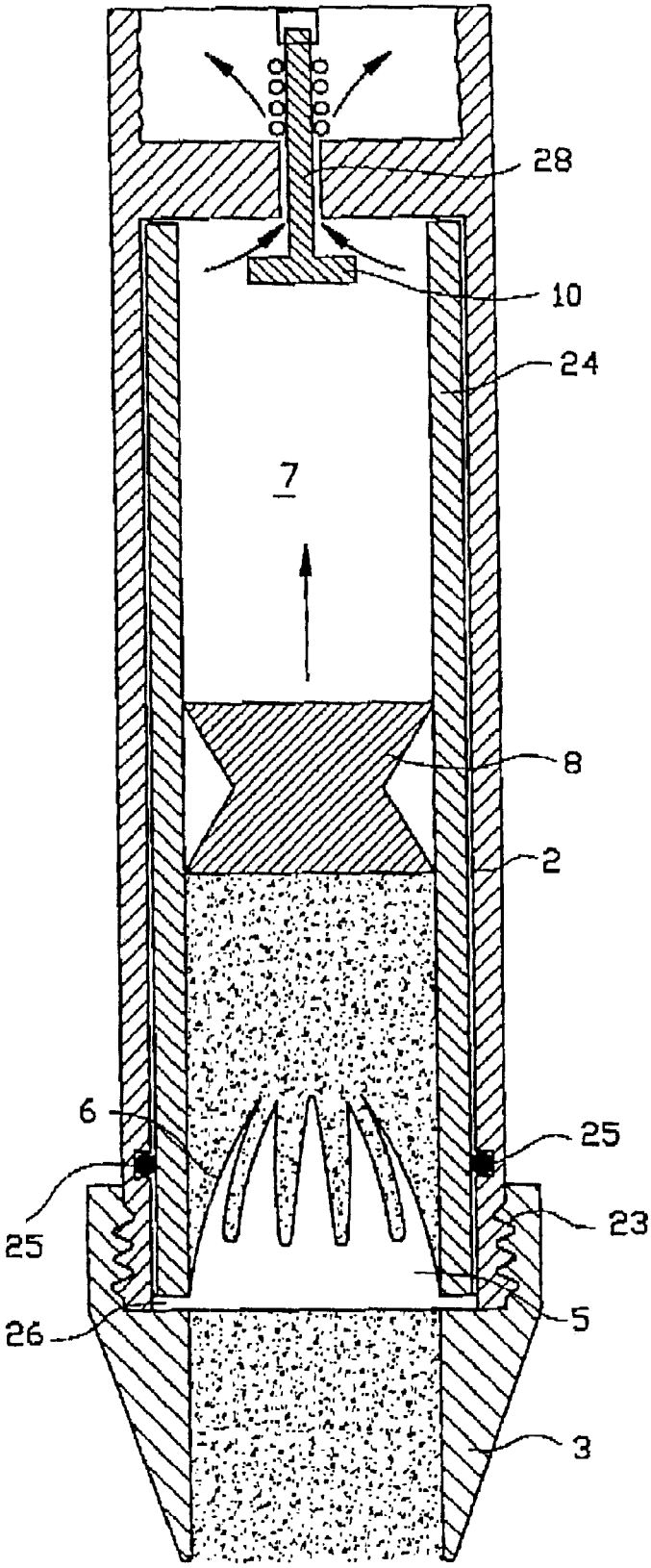
FIG. 4 is a longitudinal sectional view of a portion of a fourth embodiment of the sampler according to the invention.

In FIG. 4, a so-called rigid liner or tubing 24 is also used for the packing of a soil sample. The liner 24 is accommodated in the sampling tube 2 and forms a radial boundary of the chamber 7. The liner may be transparent. The piston 8 moves within the liner, in the same manner as is the case in the embodiment of FIG. 1. Between the cutting shoe 3 and the liner 24, the core catcher 5 is fixed with a flange 26. To prevent downward escape of the fluid via the upper edge of the liner 24 and past the outer surface of the liner 24 and the inner surface of the sampling tube 2, a sealing or O-ring 25 is placed at the bottom between the outer surface of the liner 24 and either the sampling tube 2 or the cutting shoe 3. As a result, the liners can be thin-walled and have a continuous profiling without treatments.

Preferred embodiments of the invention have been described. It is to be understood that the invention is not limited to them and that modifications and changes can be made without going beyond the spirit and scope of the following claims.

What is claimed is:

1. A soil sampler comprising a sampling tube having a receiving space for receiving a soil sample to be taken, the receiving space being limited in a radial direction by a wall, being open in a distal direction for permitting soil to enter into the receiving space and in a proximal direction being limited by a transverse wall, said sampling tube having line means for supplying and discharging fluid to the receiving space and means for closing the line means, a free plug or piston being placed in the receiving space closely fitting in there and moveable between the transverse wall and the distal area of the sampling tube and the transverse wall and the plug or piston defining a sealed chamber for fluid when the plug or piston is situated in any position at a distance from the transverse wall.

2. The soil sampler according to claim 1, wherein the soil sampler has a strike or target surface, the plug or piston having a distal surface that is a part of the strike or target surface.

3. The soil sampler according to claim 2, wherein the plug or piston has a conical distal surface.

4. The soil sampler according to claim 1, wherein the plug or piston comprises upper and lower axially oriented surfaces and a cavity in at least one of the axially oriented surfaces.

5. The soil sampler according to claim 4, wherein the plug or piston comprises a proximal surface and a cavity in the proximal surface.

6. The soil sampler according to claim 1, wherein the plug or piston comprises a proximal side in liquid-sealing engagement with the wall surface of the receiving space according to a line shaped contact.

7. The soil sampler according to claim 6, wherein the plug or piston has a diabolo-like or hourglass shape.

8. The soil sampler according to claim 1, wherein the line means comprises a fluid duct extending through the transverse wall, the closing means comprising a valve that can be remotely controlled for selectively opening the fluid duct.

9. The soil sampler according to claim 8, wherein the valve comprises a one-way valve that is biased against the distal end of the fluid duct.

10. The soil sampler according to claim 9, wherein the valve comprises a valve disc and a valve rod connected thereto, the valve rod extending through the fluid duct to a proximal side of the transverse wall and being biased at that location by means of a compression spring.

11. The soil sampler according to claim 10, wherein the fluid duct is adapted for selective discharge of fluid from the receiving space.

12. The soil sampler according to claim 11, wherein the line means comprises a separate and closable supply duct for fluid.

13. The soil sampler according to claim 1, wherein the closing means comprises a valve which is biased towards a position closing the line means by exertion of pressure by the fluid present in the receiving space.

14. The soil sampler according to claim 1, further comprising means for at least radially enveloping the soil sample to be received in the receiving space.

15. The soil sampler according to claim 14, wherein the enveloping means comprises a sleeve arranged at the distal end of the sampling tube such that the sleeve can be unwound and extending with a closed end over the open distal end of the receiving space.

16. The soil sampler according to claim 15, wherein the plug or piston is connected to the sleeve.

17. The soil sampler according to claim 14, further comprising a liner placed in the sampling tube, the liner covering the inner surface of the sampling tube at the location of the receiving space.

18. The soil sampler according to claim 17, further comprising a fluid seal placed between the liner and the sampling tube.

19. The soil sampler according to claim 17, wherein the plug or piston is in engagement with an inner surface of the liner.

20. A method for taking a soil sample comprising the steps of:

providing a sampling tube having an open end giving access to a receiving space for the soil sample;

filling the receiving space with a fluid;

thereafter forcing the sampling tube into the soil of the ground without allowing soil to enter the receiving space until a location is reached from where the soil sample is to be taken; and allowing the fluid to escape from the sampling tube while pushing the sampling tube deeper into the ground so that the soil enters the receiving space.

21. The method according to claim 20, further comprising sealing the fluid filled receiving space to the outside with a fluid sealing free piston, wherein the soil moves the piston to the inside while urging the fluid out when the soil enters.

22. The method according to claim 20, wherein when the receiving space is only partially filled with soil, the further steps of:

stopping escape of the fluid;

urging the sampling tube further into the ground to a lower spaced apart location where soil is present of which an additional sample is to be taken; and allowing the fluid again to escape while pushing the sampling tube deeper into the ground so that the desired soil enters the receiving space.

23. The method according to claim 20, further comprising the steps of:

withdrawing the soil sampler from the ground and filling the receiving space with a pressurized fluid to urge the soil sample out of the sampling tube.

* * * * *